United States Patent [19]

Behnke

[11] 4,153,017

[45] May 8, 1979

[54] ALLOYED CHILLED IRON

[75] Inventor: Robert C. Behnke, Wheaton, Ill.

[73] Assignee: Stanadyne, Inc., Windsor, Conn.

[21] Appl. No.: 797,296

[22] Filed: May 16, 1977

[51] Int. Cl.[2] ..... F01L 1/14; F01L 1/16

[52] U.S. Cl. ..... 123/90.51; 123/90.48; 75/123 CB; 75/128 D

[58] Field of Search ..... 123/90.51, 90.6, 188 AA, 123/90.48; 75/128 C, 128 D, 128 W, 128 V, 123 CB; 148/35

[56] References Cited

U.S. PATENT DOCUMENTS

| | | | |
|---|---|---|---|
| 3,370,941 | 2/1968 | Kueny | 148/35 X |
| 3,384,515 | 5/1968 | Ackerman et al. | 148/35 X |
| 3,412,721 | 11/1968 | Thompson | 123/90.51 |
| 3,502,057 | 3/1970 | Thompson | 123/90.51 |
| 3,600,238 | 8/1971 | Ravenel | 148/35 X |
| 3,627,515 | 12/1971 | Kueny | 75/128 W X |
| 3,876,475 | 4/1975 | Ramqvist | 123/188 AA X |
| 3,909,252 | 9/1975 | Kuriyama et al. | 75/128 C X |
| 4,032,334 | 6/1977 | Burk et al. | 75/128 C |

*Primary Examiner*—Ronald H. Lazarus
*Assistant Examiner*—Jeffrey L. Yates
*Attorney, Agent, or Firm*—Kinzer, Plyer, Dorn & McEachran

[57] ABSTRACT

A vehicle engine component has a specific compositon of alloyed chilled iron in which molybdenum is the major alloying element, thus producing a chilled iron with a more thermally stable carbide combined with a matrix which is stronger and more fatigue-resistant.

2 Claims, No Drawings

ALLOYED CHILLED IRON

SUMMARY OF THE INVENTION

The present invention relates to the metallurgy of vehicle engine components and more specifically to a specific metallurgical composition for tappets.

A primary purpose is a specific metallurgical composition of alloyed chilled iron in which molybdenum is the major alloying element.

Another purpose is a vehicle tappet formed of alloyed chilled cast iron which will have a more thermally stable carbide and a matrix which is stronger and more fatigue-resistant.

Another purpose is a tappet metallurgy of the type described having substantially increased amounts of molybdenum.

Another purpose is a tappet metallurgy of the type described in which the carbon and silicon proportions have been established at high levels to produce the desired high concentration of carbides.

Another purpose is an engine tappet metallurgy which is highly resistant to spalling, pitting, chipping and heat checking.

Other purposes will appear in the ensuing specification and claims.

DESCRIPTION OF THE PREFERRED EMBODIMENT

The present invention relates to tappet metallurgy of the type generally described in U.S. Pat. Nos. 3,370,941, 3,627,515 and 3,472,651 and in U.S. patent application Ser. No. 685,091, owned by the assignee of the present application. Although the metallurgy will be described in connection with an engine tappet, it may be used for other valve train components, for example, camshafts, rocker arms, distributor drive gears, valve guides and fuel pump cams or other parts where wear resistance is required. It should be understood that the entire structure will be poured from the same molten material, but that only the wear surface or camface will have the described properties due to the use of chill apparatus, such as chill plates or chill blocks.

The tappet metallurgy described, through the use of molybdenum as the major alloying element, produces a chilled iron with more thermally stable carbides, combined with a matrix which is stronger and more fatigue-resistant. The combination of these two characteristics make this chilled iron suitable for the most severe service.

Conventionally, unalloyed chilled gray iron has been universally used as a wear resistant tappet cam face running against carburized-hardened or induction hardened steel camshafts. Current service requirements, particularly in diesel engines, require that the chilled iron be upgraded with respect to camface wear and resistance to metal fatigue or pitting. Chilled iron is normally alloyed to increase the depth of chill, increase the percentage of carbides, or to produce a specified metallurgical reaction; toughness, fatigue-resistance or resistance to heat checking. The alloying elements normally used are chromium and vanadium, which are strong carbide formers. Tungsten in combination with titanium may also be used in chilled tappet bodies as shown in U.S. Pat. No. 3,627,515. Tungsten is specifically used in the specification of U.S. Pat. No. 3,370,941 and titanium is used in the specification of U.S. Pat. No. 3,472,651.

The tappet metallurgy disclosed in U.S. Pat. No. 3,370,941 has been found to be satisfactory in some respects for particular automotive applications, however, the presence of tungsten adds substantial cost to the tappet and tungsten is a weak carbide former. Titanium, used in U.S. Pat. Nos. 3,472,651 and 3,627,515 is a weak graphitizer. Chromium is the only source of carbides in the specifications of the above-mentioned patents, as neither tungsten nor titanium is a significant factor in forming carbides in their iron. The present invention does not use either tungsten or titanium, but yet provides a more thermally stable carbide combined with a matrix which is stronger and more fatigue-resistant.

The tappet metallurgy disclosed in the above-mentioned copending application eliminates tungsten and provides a higher amount of carbide in a hardened matrix after heat treatment by increasing the amounts of chromium and molybdenum over those specified in the composition of U.S. Pat. No. 3,370,941. However, in the present invention in many applications there will be no heat treatment and the material will be used in an as-cast condition. In the present specification the amount of molybdenum is substantially increased over that specified in the composition of the copending application and the amount of chromium is decreased.

Specifically, the novel material of the present invention is of the following composition:

| Element | Percent by Weight |
|---|---|
| Carbon | 3.10–3.60 |
| Silicon | 2.00–2.90 |
| Manganese | 0.60–0.90 |
| Chromium | 0.20–0.80 |
| Nickel | 0.30–0.60 |
| Molybdenum | 1.50–5.00 |
| Vanadium | 0.10–0.50 |
| Sulphur | 0.10 max. |
| Phosphorus | 0.20 max. |
| Iron | Balance |

Although the amount of molybdenum, which is the critical point in the present specification, can be in the range of 1.50–5.0 percent by weight, the preferred range for molybdenum is 1.80–2.20 percent by weight. It should be noted that the amount of chrome is less than that specified in U.S. Pat. No. 3,370,941 and the amount of molybdenum is substantially greater than that set forth in the patent. The hardness of the present material is at least equivalent and, as indicated above, there is a more thermally stable carbide combined with a stronger matrix which is more fatigue-resistant than that set forth in the '941 patent and at substantially less cost.

As a specific example of the novel composition, tappets formed with the following metallurgy have been satisfactorily tested:

| Element | Percent by Weight |
|---|---|
| Carbon | 3.36 |
| Silicon | 2.24 |
| Manganese | 0.70 |
| Chromium | 0.38 |
| Nickel | 0.34 |
| Molybdenum | 2.08 |
| Vanadium | 0.50 |
| Iron (plus other elements) | Balance |

The carbide forming potential of a chilled gray iron is determined using the Eutectic Graphitizing Tendency, which is an extension of the Carbon Equivalent normally used for controlling unalloyed gray iron. E.G.T. provides a quantitative measure of the influence of the individual alloying elements on the tendency of a particular analysis to graphitize or conversely to form carbides. The present formula reads as follows: $E.G.T. = T.C. + \frac{1}{3}Si - \frac{1}{3}Cr - 1/9Mo + 1/9Ni - V$. The E.G.T. for the present invention is in the range of 3.13–3.97. This is to be contrasted with the normal E.G.T. for unalloyed chilled iron which is in the range of 3.87–4.47. The alloyed chilled iron of the present invention thus provides a pronounced increase in stabilizing the carbide or chill.

In the present specification, the total carbon and silicon have been established at high levels to produce, with specific alloy additions, the desired and necessary high concentration of carbides. The carbon content selected produces a maximum hardness on the tappet camface or on the wear surface of the valve train component, but yet still maintains a hypoeutectic iron. This is an important consideration, particularly in the unchilled portion of the tappet body. The high silicon content increases the percentage of eutectic at solidification and increases the strength of the ferrite. Carbide forms when the eutectic solidifies and a high ratio of eutectic/austenite will result in a higher density of carbide. Silicon dissolves in the ferrite and it has a pronounced solid solution strengthening effect.

Chromium and vanadium were established at minimum levels to assure a sufficient density and depth of carbide to provide the required wear resistance. Nickel was added at a minimum level for added toughness.

The primary alloying element, molybdenum, was selected for the following reasons:

1. Molybdenum is a mild carbide former and does not increase the depth of chill significantly, which is of substantial importance when considering machinability of the castings.

2. Molybdenum partitions between the carbide and ferrite phases. Chromium and vanadium are carbide formers and do not dissolve in the ferrite.

3. Molybdenum forms a mixture of two types of carbide: a face-centered cubic $M_{23}C_6$ iron-molybdenum carbide and an orthrhombic $Fe_3C$ cementite carbide. The $M_{23}C_6$ type carbide is more stable, and this is the primary reason why molybdenum improves the heat resistance of alloy steel, cast iron and tool steels. Chromium and vanadium in small percentages dissolve in the cementite type carbides.

4. Molybdenum improves the resistance to spalling, pitting, chipping and heat checking.

5. Molybdenum hardens and toughens the pearlitic matrix, thus improving the resistance to fatigue.

The as-cast chilled iron will produce a camface hardness of Rockwell C 57 minimum. Chill depth will be in the range of 5/32–8/32 inch in the center of the tappet camface. The percentage of carbide will be in the range of 35–45%.

It should be understood that except for molybdenum there may be minor variations in the chemistry described if such deviations will provide the required camface hardness, depth of chill, percentage of carbides and specified microstructure. Tappets or other engine valve train components of the described metallurgy should be processed following good foundry procedures. Variables such as percentage of steel in the charge, superheating temperature, pouring temperature, innolucating practice, molding sand and mold rigging may also have an effect on the properties of the chilled iron of the described specification.

Although the described specification will be used in the as-cast condition on steel camshafts, in some applications the tappet may be heat treated, and it may be run against a hardenable camshaft.

Whereas the preferred form of the invention has been shown and described herein, it should be realized that there may be many modifications, substitutions and alterations thereto.

The embodiments of the invention in which an exclusive property or privilege is claimed are defined as follows:

1. An internal combustion engine tappet to be used in the as cast condition on steel camshafts and having high resistance to spalling and scuffing comprising a body having at least a wearing surface formed of chilled high strength alloy cast iron consisting essentially of the following composition:

| Element | Percent by Weight |
|---|---|
| Carbon | 3.10–3.60 |
| Silicon | 2.00–2.90 |
| Manganese | 0.60–0.90 |
| Chromium | 0.20–0.80 |
| Nickel | 0.30–0.60 |
| Molybdenum | 1.50–5.00 |
| Vanadium | 0.10–0.50 |
| Iron (plus minor sulphur and phosphorus elements) | Balance |

2. The structure of claim 1 in which the percent by weight of molybdenum is 1.80–2.20.

* * * * *